US006273696B1

(12) United States Patent
Kösters et al.

(10) Patent No.: US 6,273,696 B1
(45) Date of Patent: Aug. 14, 2001

(54) SCREW SPINDLE VACUUM PUMP AND OPERATING METHOD

(75) Inventors: Heiner Kösters, Itzehoe; Christian Dahmlos, Kremperheide, both of (DE)

(73) Assignee: Sterling Fluid Systems (Germany) GmbH, Itzehoe (DE)

( * ) Notice: Subject to any disclaimer, the term of this patent is extended or adjusted under 35 U.S.C. 154(b) by 0 days.

(21) Appl. No.: 09/445,705

(22) PCT Filed: Jun. 9, 1998

(86) PCT No.: PCT/EP98/03544

§ 371 Date: Dec. 9, 1999

§ 102(e) Date: Dec. 9, 1999

(87) PCT Pub. No.: WO98/57067

PCT Pub. Date: Dec. 17, 1998

(30) Foreign Application Priority Data

Jun. 11, 1997 (DE) ..... 197 24 643

(51) Int. Cl.[7] ..... F01C 1/16
(52) U.S. Cl. ..... 418/201.1; 418/15
(58) Field of Search ..... 418/15, 201.1

(56) References Cited

U.S. PATENT DOCUMENTS 3,129,877 * 4/1964 Nilsson et al. ..... 418/201.1
3,138,320 * 6/1964 Schibbye ..... 418/201.1
4,153,395 * 5/1979 O'Neil ..... 418/104
4,329,126 * 5/1982 Nishimura ..... 418/104
4,487,563 * 12/1984 Mori et al. ..... 418/104
4,768,934 * 9/1988 Soeters, Jr. ..... 418/15
4,781,553 * 11/1988 Nomura et al. ..... 418/201.1
4,812,110 * 3/1989 Kubo et al. ..... 418/15
4,917,583 * 4/1990 Frings et al. ..... 418/206.2
4,984,974 * 1/1991 Naya et al. ..... 418/104
5,082,427 * 1/1992 Fujiwara et al. ..... 418/15
5,269,667 * 12/1993 Mauney ..... 418/201.1
5,924,855 * 7/1999 Dahmlos et al. ..... 418/201.1

FOREIGN PATENT DOCUMENTS

2544082 * 4/1977 (DE) ..... 418/206.1
203477 * 12/1986 (EP) ..... 418/15

* cited by examiner

*Primary Examiner*—Thomas Denion
*Assistant Examiner*—Theresa Trieu
(74) *Attorney, Agent, or Firm*—Alix, Yale & Ristas, LLP

(57) ABSTRACT

Screw-spindle vacuum pump with at least three closed-off feed chambers located one behind the other along each rotor and method for operating this compressor. The chamber which is last on the delivery side is brought virtually to the compression limit pressure by means of pre-admission, shortly before it opens towards the delivery side, by supplying a pre-admission stream which is at least five times as great as the intake mass stream. A precondition, in this case, is a minimum ratio of external compression to internal compression of five.

15 Claims, 2 Drawing Sheets

SCREW SPINDLE VACUUM PUMP AND OPERATING METHOD

CROSS-REFERENCE TO RELATED APPLICATION

This is the national stage of International Application No. PCT/EP98/03544 filed Jun. 9, 1998.

BACKGROUND OF THE INVENTION

The temperature of the gas conveyed by a compressor rises according to the compression pressure ratio. In screw-type compressors which depend on the least possible play both between the two rotors and between the rotors and the casing, the thermal expansion caused on the parts of the compressor may lead to problems. It is known (DE-A-195 22 559) U.S. Pat. No. 5,924,855, by means of pre-admission, to lower the Temperature of the gas contained in the feed cells of the machine. By this is meant admitting cooler feed medium into the feed cells from a point of higher pressure. The pre-admission quantity supplied in each case to the chambers is small, as far as the efficiency of the machine is concerned. Thus, for example, when a screw-spindle machine is operated as a compressor (U.S. Pat. No. 4,812,110; U.S. Pat. No. 5,082,427), it is sufficient for only some of the conveyed gas to be recirculated for pre-admission. Also, when a screw-spindle machine is operated as a vacuum pump, it is necessary to comply with different preconditions from those occurring when it is operated as a compressor. Firstly, the pressure ratio is disproportionately higher in the vacuum mode than in the compressor mode, in particular typically well above 100. Secondly, in accordance with this pressure ratio, the temperature reached in the conveyed gas is substantially higher. Finally, it is necessary to ensure that the achievable vacuum is not impaired by pre-admission backflow.

SUMMARY OF THE INVENTION

The object on which the invention is based is to provide a screw-spindle vacuum pump and a method for operating it which, by means of pre-admission, allow effective cooling, with the efficiency and achievable vacuum being only slightly impaired.

The solution according to the invention is found in the features set forth herein. These presuppose a screw-spindle vacuum pump which, along each rotor, has at least three feed chambers located one behind the other. The latter are in each case closed off, with the exception of the play which is unavoidable in the case of dry conveyance. In such a machine, there is provision, according to the invention, for the chamber which is last on the delivery side to be brought virtually or completely to the compression limit pressure by means of pre-admission, shortly before it opens towards the delivery side, by admitting a pre-admission stream of cool gas which is at least five times greater than the intake mass stream. In this case, an operating point is presupposed, at which the ratio of external compression to internal compression is at least five. On he one hand, effective cooling in the region of the rotors which is the most critical for temperature control is thereby achieved. On the other hand, this cooling also has an effect on the penultimate chamber, since some of the cooler gas in the last chamber, the said gas being under substantially higher pressure, flows back to the penultimate chamber. Finally, the advantage of this arrangement is that there is a considerable reduction in noise being generated, because, when the last chamber opens towards the delivery side, pressure equalization has already been essentially completed. This means that at least 75% of the limit pressure, preferably 90%, is reached by means of pre-admission before the last chamber opens on the delivery side.

In known machines having a smaller number of chambers, such high pre-admission is not possible, because, due to pronounced leakage losses, the pressure in the chamber has already risen relatively sharply when the outlet is opened, and, consequently, a lower pressure difference is available for pre-admission.

Also, in this respect, the considerable difference in the pressure ratio between compressors and vacuum pumps once again plays a part; owing to the lower pressure ratio, a relatively higher pressure prevails in the chamber opening towards the outlet in the case of compressors than in the case of vacuum pumps.

By internal compression is to be meant the ratio of the volumes of the chamber nearest to the suction side, when this chamber closes, and of the chamber nearest to the delivery side, when this chamber opens. If the cross-sectional shape of the screw-spindles is constant over their length, internal compression is equal to 1.

Another possibility for defining the pre-admission according to the invention is that the pre-admission volume stream supplied to the chamber which is last on the delivery side, before the latter opens towards the delivery side, is to be greater than 75% of the theoretical suction capacity of this chamber at the time of pre-admission, divided by the internal compression ratio. If pre-admission extends over a timespan of appreciable length, the time at which pre-admission ends is to be taken as a basis. Instead, the mid-point in time between the opening and closing of pre-admission may also be taken as a basis. The volume stream must be related to the outlet pressure and to the temperature of the gas to be admitted. The theoretical suction capacity is the volume of the chamber at the critical time, multiplied by the rotational speed.

The hitherto conventional small pre-admission orifices, in which a considerable throttle effect is inherent, are not sufficient for this purpose. According to a rule of thumb, the cross-section of the pre-admission orifice in $mm^2$ should be at least as great as the theoretical suction capacity of the associated chamber in $m^3/h$, but preferably twice, furthermore preferably three times as great. This, of course, presupposes that the pre-admission orifice, that is to say the wall orifice which introduces the gas into the chamber, is not preceded by any narrower cross-sections which once again impair the effect of the orifice width. In this respect, the theoretical suction capacity of the chamber is the product of the volume of this feed chamber, the number of screw flights and the rotational speed, the maximum rotational speed to be expected in continuous operation being taken as a basis.

This definition of the theoretical suction capacity, in contrast to the definition given above contains the number of screw flights as a factor. This is explained by the fact that, here, all hose admission orifices are referred to which may be assigned simultaneously to a plurality of chambers in the case of a multi-flight screw spindle, whereas only a single chamber is considered above.

The strong pre-admission according to the invention in the last stage is particularly effective when the screw-flight pitch of the rotors is constant, that is to say compression theoretically takes place isochorically. However, in the case of a decreasing pitch, the invention proves appropriate, since, as a rule, the pitch is never reduced to such an extent that, even without pre-admission in the last stage, the limit pressure is reached when the pump is at the normal operating point. Moreover, the invention does not rule out also providing weak pre-admission in earlier stages in addition to the strong pre-admission in the last stage, although this is unnecessary or even undesirable in most instances of use.

Since the pre-admission according to the invention takes place only in the last stage and at least three successive feed chambers are provided, the impairment of the suction capacity of the vacuum pump is negligible, provided that the rotational speed is not too low.

BRIEF DESCRIPTION OF THE DRAWINGS

The invention is explained in more detail below with reference to the drawings wherein.

DETAILED DESCRIPTION OF THE INVENTION.

Figure 1:
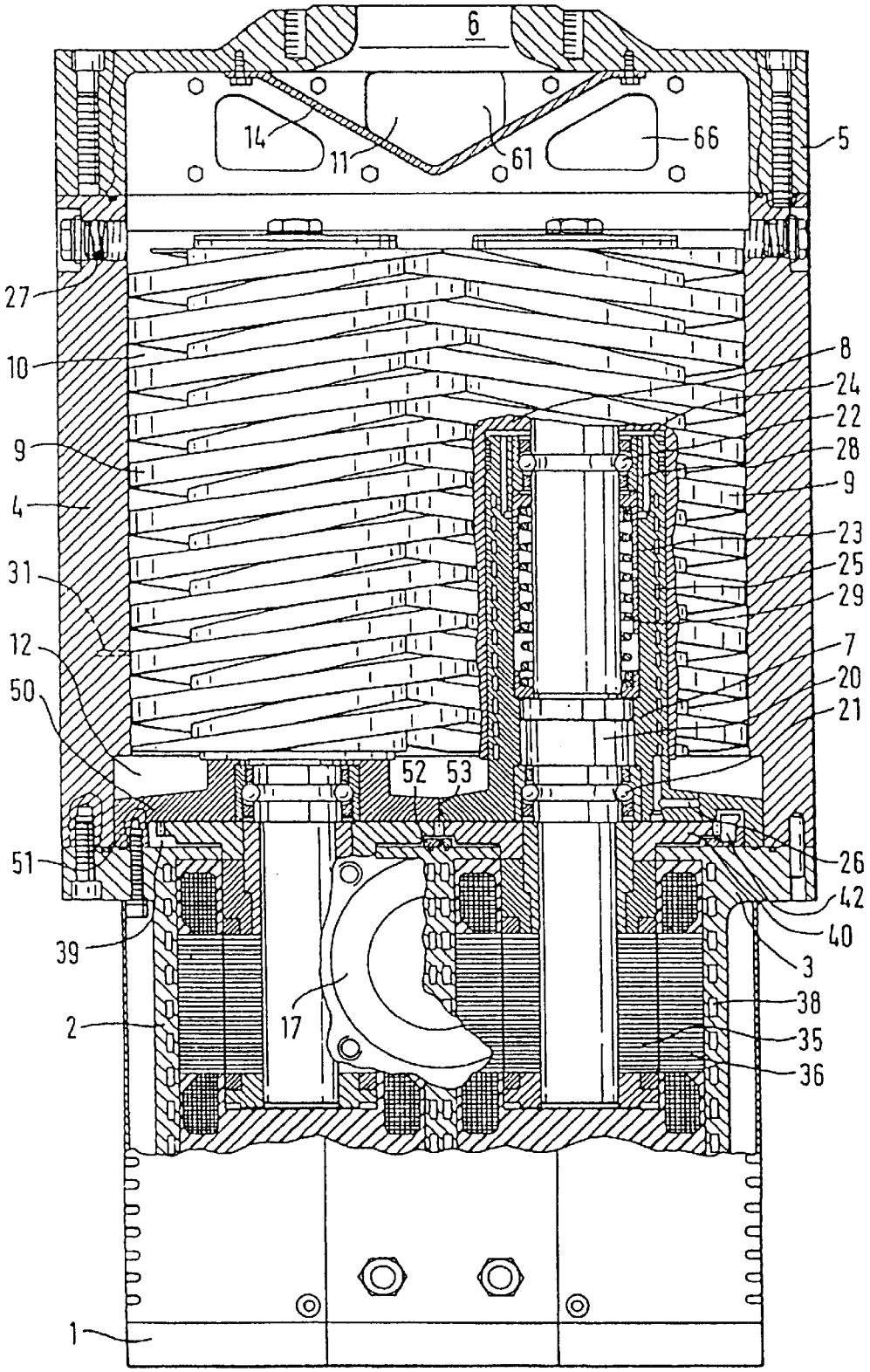
Fig. 1 PRIOR ART
FIG. 1 is a longitudinal sectional view of a screw-spindle vacuum pump of the type used in the present invention.
Figure 4:
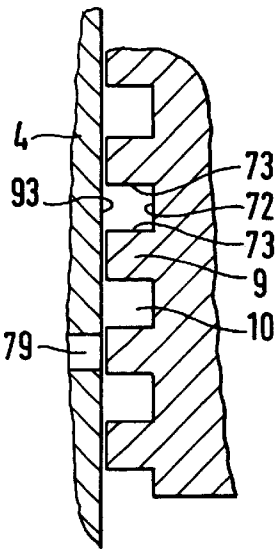
FIG. 4 is a sectional view taken along the line IV—IV of FIG. 2.

Referring now to the drawings in greater detail, FIG. 1 illustrates a known screw-type compressor as disclosed in U.S. Pat. No. 5,924,855, the disclosure of which is incorporated herein by reference.

Resting on the foot part 1 is the motor housing 2, which is connected, if need be in one piece, at the top to the flange-like base plate 3 on which the pump-chamber housing 4 is mounted the latter is closed off at the top by a lid 5 which contains a suction opening 6.

Fastened to the base plate 3 are the flange plates 50 of the bearing bodies 7, which in each case serve to carry a rotor 8, the periphery of which has displacement projections 9 which are preferably arranged as a two-start helix and engage like the meshing of teeth in the delivery hollow spaces 10 between the displacement projections 9 of the adjacent rotor. In addition, the displacement projections 9 interact at the periphery with the inner surface of the pump-chamber housing part 4. The rotors 8 are connected at the top to the suction space 11 and at the bottom to the pressure space 12.

The pressure space 12 is connected to a pressure outlet (not shown). These parts are provided at the bottom end of the vertically mounted pump-chamber housing.

Each rotor 8 is connected in a rotationally locked manner to a shaft 20 which is mounted at the bottom in the bearing body 7 by a permanently lubricated rolling bearing 21. A second, likewise permanently lubricated rolling bearing 22 is located at the top end of a tubular part 23 of the bearing body 7, which projects into a concentric bore 24 of the rotor 8, which bore 24 is open towards the bottom, i.e. on the pressure side. This bearing 22 is preferably located above the center of the rotor 8. The tubular part 23 of the bearing body preferably extends through most of the length of the rotor 8. In a vertical arrangement of the pump, then end of the tubular part 23 lies substantially higher than the pressure outlet 17. This helps to protect the bearing and drive region from the ingress of liquid or other heavy impurities from the pump chamber.

Provided in the tubular part 23 of the bearing body are cooling passages 25 which are connected via passages 26 to a cooling-water source and via corresponding passages (not shown in the drawing) to a cooling-water discharge. The cooling passages 25 are preferably formed by helical turned recesses which are tightly covered by a sleeve. The cooling of the rotor bearings prolongs the service life of the maintenance intervals of these bearings if they are permanently lubricated with grease. Furthermore, the peripheral surface of the tubular part 23 of the bearing body is also kept at a low temperature by the cooling. This peripheral surface is opposite the inner peripheral surface of the hollow space 24 of the rotor at a slight distance apart. These surfaces are designed in such a way that they are capable of good heat exchange and therefore heat can be dissipated from the rotor indirectly via the tubular part 23 of the bearing body and its cooling devices 25. The surfaces, opposite one another, of the tubular part 23 of the bearing body and the rotor hollow space 24 may be designed in a suitable manner in order to improve the heat exchange between them. It is possible to feed a sealing gas to the rotor hollow space 24 through the bearing body or the shaft 20, which sealing gas is Clean copy of amended paragraphs and new claims. discharged with the delivery medium form the pressure space 12. Apart from the sealing of the bearing region, it can also serve to additionally cool the bearing, the bearing body and the rotor, but in this case it is expediently not directed through the bearing or bearings in order not to contaminate the latter but is directed via a passage 28 forming a bypass.

The delivery effect can be brought about by the gap between rotor and bearing body widening conically towards the pressure space. Here, the gap width (distance of the surface of the bearing body from the surface of the rotor) remains essentially constant. In addition, the surfaces opposite one another may also be provided in this case with a delivery thread on one side or both sides, but this is not necessary.

Since the equipping of the gap between rotor and bearing body with a delivery thread or conicity acting in a delivering manner provides a very effective seal against the ingress of liquid or solid particles, additional sealing devices may often be dispensed with; however, they may be provided, and in fact preferably in a non-contact or minimum-contact type of construction, e.g. labyrinth seals or piston-ring-like seals.

On account of the sealing action of the delivery thread or the gap conicity, the pump according to the invention is insensitive to the presence of liquid in the pump chamber as long as the rotors are rotating. This insensitivity also exists in the stationary state owing to the high bearing arrangement in the rotor as long as the liquid in the pump chamber does not reach the bearing level. It is not only important when the delivery medium carries a liquid surge with it but may also be utilized for cleaning and/or cooling the pump by liquid injection. For example, cleaning or cooling liquid can be injected through nozzles, of which one is indicated at 27. The same or separate nozzles 27 may be used for injecting the cleaning liquid and the cooling liquid. The delivery action in the gap between rotor and bearing body may also be utilized to deliver sealing gas independently of an external compressed-gas source. However, to deliver the sealing gas independently of a external compressed-gas source. However, to deliver the sealing gas, the action of such a compressed-gas source will generally be preferred in order to feed the sealing gas independently of the rotor speed. Cooling of the housing shell is not necessary in all cases. However, in the context according to the invention it is advantageously possible, since the rotors 8 are also cooled and their thermal expansion is therefore limited. It need not be feared that the rotors run against the housing only because they expand, while the housing is kept at a lower temperature.

The pump according to the invention may be provided with pre-admission. This means that passages 31 are provided in the areas of higher, or possible even average, compression in the housing, through which passages 31 gas of higher pressure than corresponds to the compression state in this area of the pump chamber is let into the pump chamber in order to effect cooling and/or noise reduction according to known principles. According to an advantageous feature of the invention, the pre-admission gas can be extracted directly form the pressure side of the pump by being cooled.

The rolling bearings 21, 22 in the example shown are angular-contact ball bearings which are set against one another by a spring 29. Each shaft 20 carries the armature 35 of the drive motor below the bearing 21, preferably directly, i.e. without an intermediate coupling, the stator 36 of which drive motor is arranged in the motor housing 2. The motor housing may be provided with cooling passages 38.

The flange plates 50, which in the example shown are made in piece with the bearing bodies 7, are mounted with their outer margins 51, which essentially follow the periphery of the pump-chamber housing 4, and their abutting inner margins 52 on the top side of the base plate 3. The flange plates 50 are sealed relative to the base plate 3. The end faces 53, which follow a secant in radial section and at which the flange plates 50 bear against one another, are also provided with a sealing insert.

A turned recess is provided below the flange plates 50 between the margins 51, 52 which turned recess encloses with the top side of the base plate 3 a space 39 which serves to accommodate synchronization gear wheels 40 which are arranged in a rotationally locked manner with known means on the shafts 20 between the bearings 21 and the motor armatures. So that they can mesh with one another in the area of the inner margins 52 of the flange plates 50, the inner margins have a cut-out at an appropriate point, through which cut-out the gear wheels reach. Remaining below this cut-out on each side is a web to which the reference line of the reference numeral 52 generally designating the inner margin points in FIG. 1. This web is advantageous not only for stability reasons but also because it permits an encircling seal on the one hand relative to the base plate 3 and on the other hand between the flattened secant faces of the flange plates 50.

The turned-out portions 39 in the flange plates 50 have a diameter which is greater than the diameter of the synchronization gear wheels 40. They are arranged with slight eccentricity in relation to the inner margins 52 so that the synchronization gear wheels 40 can be inserted upon assembly of the rotor construction units despite the presence of the sealing web at 52.

Since the space 39 containing the synchronization gear wheels 40 is completely separate from the pump chamber, there is no risk of the synchronization gear wheels becoming contaminated. They are merely used for the emergency synchronization of the rotors. Their teeth normally do not come in contact with one another. Lubrication is therefore unnecessary as a rule. Although it may be used if desired, the dry running of the synchronization gear wheels simplifies the construction, since sealing between the space 39 and the drive motors is not necessary.

The synchronization gear wheels 40 may also serve as pulse generator discs or may be supplemented by additional pulse generator discs which are scanned by sensors 42, of which one is shown in FIG. 1. These sensors 42 are connected to a control device which monitors the respective rotary position of the rotors relative to a set point and corrects it via the drive. This concerns electronic synchronization of the rotors, which is known as such and therefore need not be explained in more detail here. The play between the teeth of the synchronization gear wheels 40 is slightly smaller than the flank clearance between the displacement projections 9 of the rotors 8. However, it is greater than the synchronization tolerance of the electronic synchronization device. During proper functioning of the latter, therefore, neither the flanks of the displacement bodies 9 nor the teeth of the synchronization gear wheels 40 come in contact with one another. In the event of the latter nonetheless coming in contact with one another, they are provided with a wear-resistant and if need be slidable coating.

The performance data of the pump, apart from being determined by the drive output and rotational speed, are determined by the displacement or delivery volume formed at the rotors and thus by the length of the rotors. The delivery data may therefore be altered by altering the length of the pump part containing the rotors. A series of pumps having different performance data is therefore preferably distinguished by the fact that the individual pumps of this series differ through graduation of the length of these parts, to which the pump-chamber housing, the rotors and if need by the tubular parts, projecting into the rotors, of the bearing bodies belong.

It will be recognized that each rotor forms with the associated bearing and drive devices a construction unit which can be mounted independently and, apart from the rotor, consists of the bearings 21, 22, the bearing body 7, the cooling devices provided therein, the shaft 20, the synchronization gear wheel 40, the associated sensor 42 and the motor armature 35. These units are inserted into the pump in a completely preassembled manner. They can easily be removed from the base plate 3 or inserted after removal of the pump-chamber housing. The exchanging of these units can therefore be left to the user, whereas the manufacturer takes care of the maintenance of the sensitive units as such.

The pump is preferably of isochoric type of construction so that larger liquid quantities can also be safely delivered.

Figure 3:
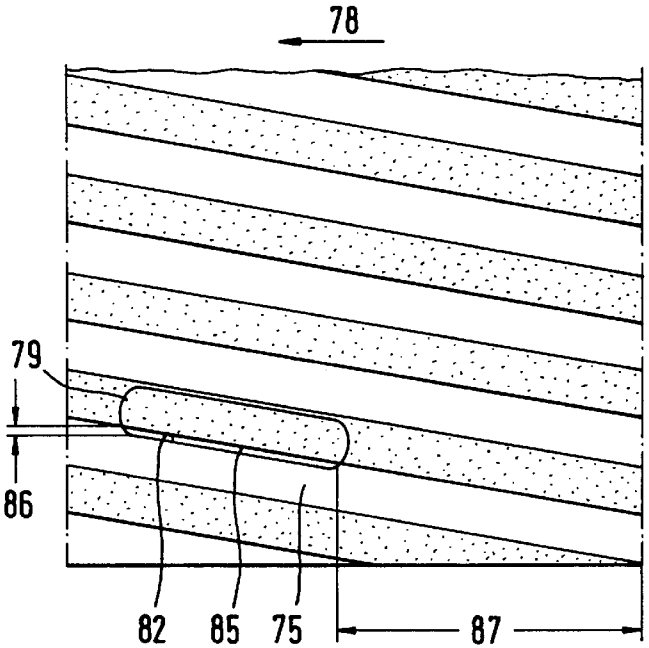
FIG. 3 is a view similar to FIG. 2 illustrating a different embodiment.
Figure 2:
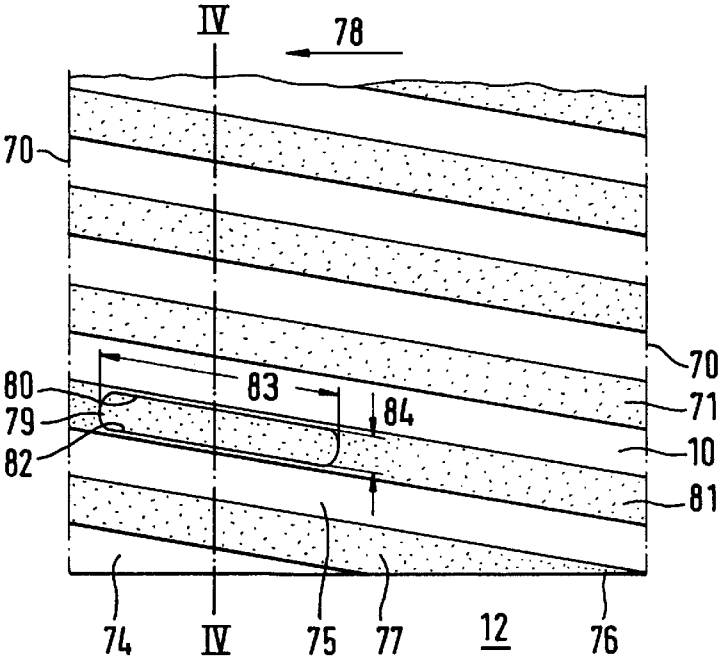
FIG. 2 is an illustration of the 360° circumference of one of the rotors of FIG. 1 with a pre-admission orifice covered by a face of a screw thread of the rotor.

FIGS. 2 and 3 show the development of the circumference of one of the rotors 8. Between the dash-dotted boundaries 70 they show the entire circumference of one rotor through 360°. The dotted bands show the head surface 71 of the displacement projections which in FIG. 1 appear as screw threads 9. Therebetween are the delivery-hollow spaces 10 formed by the grooves between the screw threads 9. The grooves form delivery chambers with are limited by the bottom 72, the flanks 73 of the adjacent screw threads 9 and the inner surface 93 of the housing 4. The ends of each chamber are formed by the mesh with the screw thread of the other rotor. Assuming that the mutual mesh of the rotors takes place at the dash-dotted lines 70 and is closed at the lines 70 by such mesh. The rotor is supposed to rotate such that its surface moves in the direction of the arrow 78. The chambers 10, therefore, appear to move downwards towards the pressure space 12. Looking at FIG. 1 it is apparent there are a number of chambers formed between subsequent threads 9.

Since the rotors with respect to each other and to the housing move without contact, there are gaps between the head surfaces 71 of the screw threads 9 and the inner surface 93 of the housing as well as between the surfaces of the screw threads of one rotor and the surfaces of the grooves of the other rotor which are in mutual engagement. As a result leakage occurs if the pressure in one chamber is higher than that in the subsequent chamber. If there were no leakage, the pressure of each chamber would remain unchanged on the level of the suction pressure from the time when it is open to the suction side until it opens to the pressure side or to the pre-admission port 31. Since there is leakage, however, the pressure in subsequent chambers rises during their movement from the suction to the pressure side. In consideration thereof they are called stages. The pump shown in FIG. 1 has ten stages.

The wall 4 of the casing contains a pre-admission port 79 the contour whereof is shown in FIGS. 2 and 3. The suction side delimiting edge 80 of the pre-admission port 79 runs parallel to the associated displacement screw thread 81. The same is true for the pressure side delimiting edge 82. The length 83 of the pre-admission orifice in the illustrated embodiments is about ⅖ of the length of the circumference of the rotor which means that it is greater than 1/10 of the rotor diameter.

As far as the width 84 of the pre-admission orifice in the axial direction is concerned, FIGS. 2 and 3 show different embodiments. In FIG. 2 the width 84 is smaller than the width of the head of the displacement screw thread 81. In the embodiment of FIG. 3 the width of the orifice is greater.

FIGS. 2 and 3 show the last chamber 74 in a state completely open to the pressure space 12. The subsequent chamber 75 is in the position in which it is just opening to the delivery side since the end 76 of the screw thread 77 delimiting the chamber 75 on its pressure side is just leaving the place (line 70) where it meshes with the other rotor in order to close the end of chamber 75.

The embodiment of FIG. 2 shows that the pre-admission orifice 79 is just covered by the screw thread 81. In contrast, FIG. 3 shows that the pressure side delimiting edge 82 of the orifice extends still beyond the corresponding edge 85 of the screw thread 81. The free axial projecting length of the pre-admission orifice beyond the covering edge is indicated at 86. The distance of the end of the uncovered part of the orifice from the end 76 of the screw thread 77 is shown at 87. The distance 86 should be smaller than the distance 87 multiplied by the number of revolutions and divided by the sound velocity.

Naturally, the pre-admission time is not sufficient to raise the pressure in the respective chamber up to the pressure in the pressure space 12. That means that a pressure wave intrudes the chamber 75 when it opens towards the pressure space 12. For the reasons set out hereinbefore this pressure wave shall not reach the pre-admission orifice. In the embodiment of FIG. 2 this is clearly avoided because the orifice is closed by the screw thread 81. In the embodiment of FIG. 3 it is prevented too, if the condition is met that the time which the pressure wave needs for the distance 87 equals or is larger than the time which the edge 85 needs in its downward movement through the distance 86. If this condition is met, the orifice 79 is closed when the pressure wave there arrives.

In an advantageous embodiment of the vacuum pump according to the invention, the pre-admission orifice is designed as a slot, in which at least the delivery-side delimiting edge is designed to be parallel to the associated displacement screw flight. This affords the advantage that the slot is open with the largest possible cross-section until the last possible moment. The slot length is expediently to be greater than 1/10 of the rotor diameter, preferably also greater than ⅕. It is expediently of the order of magnitude of one third of the rotor diameter. The width of the pre-admission orifice in the axial direction is expediently between half and the full head width (measured in the same direction) of the displacement screw flight. It may even exceed the head width a little, as long as the pre-admission filling of the chamber which is last on the delivery side is not put at risk by the connection already being made between the ore-admission orifice and the following chamber.

The suction-side delimiting edge of the pre-admission orifice may also run parallel to the associated displacement screw flight. It may be more expedient, however, to design the suction-side delimiting edge so as to be at least partially inclined relative to the associated displacement screw flight, in order thereby to avoid the pre-admission oririce opening abruptly, which could entail an undesirable generation of noise, in favour of gradual opening. The aim, in general, is to ensure that the pre-admission orifice is closed before the chamber opens on the delivery side. In other words, the pre-admission orifice is just covered by the associated screw flight when the rotor is in the position in which the chamber is just opening on the delivery side. This, for example, prevents a pressure surge penetrating into the chamber from the delivery side during opening from advancing as far as the pre-admission orifice and from driving back into the latter heated gas which would reduce the cooling effect in the next pre-admission operation. Unpleasant noise can also be avoided thereby. In many instances, however, it is not necessary for the pre-admission orifice to be already closed when the chamber opens on the delivery side, provided that care is taken to ensure that the pre-admission orifice is closed within that timespan which the pressure pulse emanating at sound velocity from the opening of the chamber on the delivery side would require until the pre-admission orifice were reached. In other words, the free axial projecting length of the pre-admission orifice beyond the covering edge of the associated screw flight should be smaller than the distance of the said pre-admission orifice from that end of the screw flight which constitutes the opening of the chamber on the delivery side, multiplied by the rotational speed and divided by the sound velocity.

It is sufficient, in general, if these conditions, which are provided for avoiding undesirable interaction between the pre-admission orifice and the opening of the chamber on the delivery side, are present at a high operating speed (for example, of 6000 $min^{-1}$) because these disadvantages are less significant at lower speeds.

The above statements presupposed that pre-admission is controlled by the interaction of the pre-admission orifice with the head face of a screw flight. Although this is a preferred version, it should not be ruled out for the pre-admission orifice to be preceded by valves which are responsible, or partly responsible in conjunction with the screw flight head face, for controlling the pre-admission time.

It may be pointed out that the term "pre-admission orifice" or "slot" does not demand that the orifice be undivided. For reasons of production economy, such an orifice may be composed, for example, of a multiplicity of individual bores which are separated from one another by means of webs. This affords the advantage that pre-admission may take place by appropriately extending the pre-admission orifice over a greater part of the chamber length. In a preferred version, the pre-admission orifice composed of a plurality of separate part orifices extends over at least half the chamber length. It may amount to up to 270°.

What is claimed is:

1. A method for operating a screw-spindle vacuum pump having at least two rotating screw spindles extending from a suction side to a delivery side of a pump chamber, each said spindle comprising a helical screw flight defining at least three conveying chambers located one behind the other and substantially closed off from each other, each said conveying chamber having a theoretical suction capacity equal to the volume of said conveying chamber multiplied by the rotational speed of said spindles, said pump having an internal pressure and operating in an environment defining an external pressure and having an internal compression ratio and at least one pre-admission port for each said spindle, said method comprising the steps of:

rotating said spindles to capture a volume of intake gas in each said conveying chamber, said conveying chambers advancing along the pump chamber from said suction side toward said delivery side; and admitting a charge of cooling gas through each said pre-admission port into each said conveying chamber before each said conveying chamber opens to the delivery side of said pump chamber, wherein said charge of cooling gas has a volume equal to at least 75% of the theoretical suction capacity of said conveying chamber divided by said internal compression ratio.

2. A method for operating a screw-spindle vacuum pump having at least two rotating screw spindles extending from a suction side to a delivery side of a pump chamber, each said spindle comprising a helical screw flight defining at least three conveying chambers located one behind the other and substantially closed off from each other and at least one pre-admission port associated with each spindle, each rotation of each said spindle capturing an intake mass stream in at least one of said conveying chambers, said pump having an internal pressure and operating in an environment defining an external pressure, said internal pressure being at least five times less than said external pressure, said method comprising the steps of:

rotating said spindles to capture an intake charge having a mass in each said conveying chamber, said conveying chambers advancing along the pump chamber from said suction side toward said delivery side; and admitting a charge of cooling gas having a second mass through each said pre-admission port into each said conveying chamber before each said conveying chamber opens to the delivery side of said pump chamber, wherein the mass of said cooling charge is at least 5 times larger than the mass of said intake charge.

3. A screw spindle vacuum pump comprising:

a pump chamber extending from a suction side to a delivery side;

first and second displacement rotors having at least one screw flight, said at least one screw flight of said first displacement rotor engaging said at least one screw flight of said second displacement rotor to define a series of at least three closed-off conveying chambers associated with each of said first and second displacement rotors, each said series of conveying chambers extending from said suction side to said delivery side and including a last chamber which is last on the delivery side; and at least one pre-admission orifice for each said displacement rotor, each said pre-admission orifice having a cross-sectional area measured in $mm^2$ and positioned to admit a charge of cooling gas to each said last chamber, wherein each said conveying chamber has a theoretical suction capacity measured in $m^3/h$ equal to a volume of the conveying chamber multiplied by a rotational speed of said first and second displacement rotors and the numerical value of the cross-sectional area of each said pre-admission orifice is at least equal to the numerical value of the theoretical suction capacity of each said conveying chamber.

4. The screw spindle vacuum pump of claim 3 wherein said pre-admission orifice is configured as a slot having a suction side delimiting edge and a delivery side delimiting edge and at least the delivery side delimiting edge is substantially parallel to an adjacent screw flight.

5. The screw spindle vacuum pump of claim 3, wherein said each said displacement rotor has a diameter and said pre-admission orifice is configured as a slot having a length greater than 1/10 of the diameter of the displacement rotor.

6. The screw spindle vacuum pump of claim 4, wherein said pump chamber has an axis and each said screw flight radially terminates in a head having a first axial width and said pre-admission orifice has a second axial width measured between said suction side and delivery side delimiting edges and said second axial width is between one half and one times said first axial width.

7. The screw spindle vacuum pump of claim 4, wherein each said screw flight radially terminates in a head having a first axial width and said pre-admission orifice has a second axial width measured between said suction side and delivery side delimiting edges and said second axial width is greater than said first axial width.

8. The screw spindle vacuum pump of claim 4, wherein the suction side delimiting edge is substantially parallel to said adjacent screw flight.

9. The screw spindle vacuum pump of claim 4, wherein the suction side delimiting edge is at least partially non parallel to said adjacent screw flight.

10. The screw spindle vacuum pump of claim 4, wherein said pre-admission orifice is covered by the adjacent screw flight when said last chamber begins to open on the delivery side.

11. The screw spindle vacuum pump of claim 4, wherein said pre-admission orifice has not yet been covered by an adjacent screw flight when said last chamber begins to open on the delivery side, resulting in an uncovered portion of said pre-admission orifice having an axial dimension.

12. The screw spindle vacuum pump of claim 11, wherein said last chamber opens at an opening location relative to said uncovered portion so that a pressure wave entering said feed chamber at said opening location cannot reach said uncovered portion before said uncovered portion is covered by said adjacent screw flight.

13. The screw spindle vacuum pump of claim 12, wherein said uncovered portion is located a distance along said conveying chamber from said opening location and said axial dimension is less than said distance along said conveying chamber multiplied by the rotational speed of said first and second rotors divided by the speed of sound.

14. The screw spindle vacuum pump of claim 3, wherein said pre-admission orifice comprises a plurality of bores.

15. The screw spindle vacuum pump of claim 3, wherein said pre-admission orifice comprises a plurality of bores extending over at least half a length of said feed chamber.

* * * * *